US007246539B2

(12) United States Patent
Turner

(10) Patent No.: US 7,246,539 B2
(45) Date of Patent: Jul. 24, 2007

(54) APPARATUS FOR ACTUATING A CONTROL SURFACE

(75) Inventor: Mark A. Turner, Arlington, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 261 days.

(21) Appl. No.: 11/034,044

(22) Filed: Jan. 12, 2005

(65) Prior Publication Data

US 2006/0150765 A1 Jul. 13, 2006

(51) Int. Cl.
*F42B 10/64* (2006.01)

(52) U.S. Cl. ..... 74/665 N; 244/3.24; 244/225

(58) Field of Classification Search ..... 74/661, 74/665 L, 665 N; 244/3.21, 3.24
See application file for complete search history.

(56) References Cited

U.S. PATENT DOCUMENTS 6,637,699 B2 * 10/2003 Banks et al. ..... 244/3.21
2005/0224632 A1 * 10/2005 Turner ..... 244/3.24

* cited by examiner

*Primary Examiner*—Dirk Wright
*Assistant Examiner*—Derek D. Knight
(74) *Attorney, Agent, or Firm*—Daren C. Davis; James E. Walton

(57) ABSTRACT

An apparatus for actuating a control surface includes a first spur gear; a first drive assembly engaged with the first spur gear; a second spur gear; and a second drive assembly engaged with the second spur gear. The apparatus further includes a gear assembly engaged with the first spur gear and the second spur gear and adapted to be coupled with the control surface.

24 Claims, 9 Drawing Sheets

APPARATUS FOR ACTUATING A CONTROL SURFACE

BACKGROUND OF THE INVENTION

1. Field of the Invention

The present invention is directed to an attitudinal control apparatus for an airborne or water borne vehicle and, in particular, an apparatus for actuating a control surface of such vehicles.

2. Description of the Related Art

Airborne or water borne vehicles are often used to deliver a payload to a target location or to carry a payload over a desired area. For example, projectiles may be used in combat situations to deliver a payload, such as an explosive warhead or a kinetic energy penetrator to a target to disable or destroy the target. Surveillance vehicles may carry a payload designed to sense certain conditions surrounding the vehicle, such as objects on the ground or weather activity. Such vehicles typically include a plurality of control surfaces, such as fins, canards, flares, flaps, tabs, etc., that are articulated to control the vehicle's direction and attitude as it moves through an atmosphere or liquid.

In many conventional vehicles, a separate actuation apparatus (e.g., a motor and a power transmission system) is provided for each of the control surfaces. For example, if a projectile includes four fins, four separate motor and power transmission assemblies would be provided. In such vehicles, one or more computers determine the desired attitude components (i.e., pitch, yaw, and roll) of the vehicle depending upon its destination, direction of travel, obstacles in its path, and other factors. The computer or computers then calculate the required orientation of the control surfaces to attain the desired vehicle attitude and command each of the actuation apparatuses separately to orient the control surfaces accordingly.

It is generally desirable, however, for such vehicles to be lighter in weight, rather than heavier, so that their ranges may be extended while using an equivalent amount of propellant. Further, it is generally desirable for the contents of the vehicle other than the payload, e.g., the motors, power transmission assemblies, and the like, to be more compact, so that larger payloads may be used within the body of the projectile. It is also often desirable to decrease the complexity of calculating the required orientation of the control surfaces to attain the desired vehicle orientation and commanding the actuation apparatuses to orient the control surfaces accordingly.

The present invention is directed to overcoming, or at least reducing, the effects of one or more of the problems set forth above.

SUMMARY OF THE INVENTION

In one aspect of the present invention, an apparatus for actuating a control surface is provided. The apparatus includes a first spur gear; a first drive assembly engaged with the first spur gear; a second spur gear; and a second drive assembly engaged with the second spur gear. The apparatus further includes a gear assembly engaged with the first spur gear and the second spur gear and adapted to be coupled with the control surface.

In another aspect of the present invention, an apparatus for actuating a plurality of control surfaces is provided. The apparatus includes a first spur gear, a second spur gear, and a third spur gear; a first drive assembly engaged with the first spur gear; a second drive assembly engaged with the second spur gear; and a third drive assembly engaged with the third spur gear. The apparatus further includes a first gear assembly engaged with the first spur gear and third spur gear and adapted to be coupled to a first of the plurality of control surfaces and a second gear assembly engaged with the second spur gear and the third spur gear and adapted to be coupled to a second of the plurality of control surfaces.

In yet another aspect of the present invention, a vehicle is provided. The vehicle includes a plurality of control surfaces; a first spur gear, a second spur gear, and a third spur gear; a first drive assembly engaged with the first spur gear; a second drive assembly engaged with the second spur gear; and a third drive assembly engaged with the third spur gear. The vehicle further includes a first gear assembly engaged with the first spur gear and third spur gear and coupled with a first of the plurality of control surfaces and a second gear assembly engaged with the second spur gear and the third spur gear and coupled with a second of the plurality of control surfaces.

In another aspect of the present invention, a vehicle is provided. The vehicle includes a first yaw and roll control surface, a second yaw and roll control surface, a first pitch and roll control surface, and a second pitch and roll control surface. The vehicle further includes a yaw spur gear, a pitch spur gear, and a roll spur gear; a yaw drive assembly engaged with the yaw spur gear; a pitch drive assembly engaged with the pitch spur gear; and a roll drive assembly engaged with the roll spur gear. The vehicle also includes a first yaw and roll gear assembly engaged with the yaw spur gear and roll spur gear and coupled with the first yaw and roll control surface; a second yaw and roll gear assembly engaged with the yaw spur gear and roll spur gear and coupled with the second yaw and roll control surface; a first pitch and roll gear assembly engaged with the pitch spur gear and the roll spur gear and coupled with the first pitch and roll control surface; and a second pitch and roll gear assembly engaged with the pitch spur gear and the roll spur gear and coupled with the second pitch and roll control surface.

BRIEF DESCRIPTION OF THE DRAWINGS

The invention may be understood by reference to the following description taken in conjunction with the accompanying drawings, in which like reference numerals identify like elements, and in which.

Figure 1:
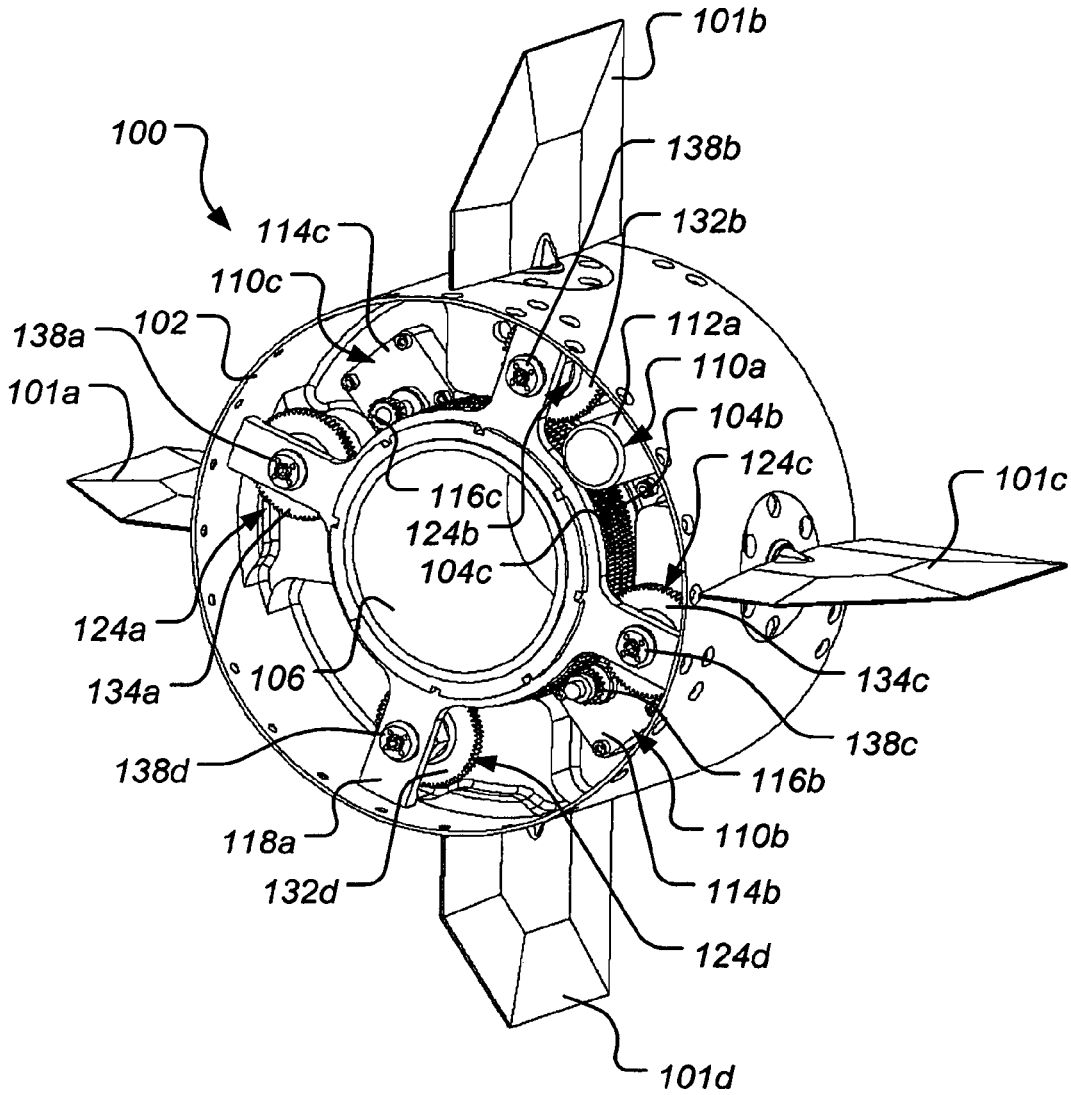
FIG. 1 is a perspective view of an actuation apparatus according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention relates to an apparatus and method for actuating control surfaces (e.g., fins, canards, flaps, flares, tabs, etc.) of an airborne or water borne vehicle. In particular, the present invention provides an apparatus for actuating a number of control surfaces with a lesser number of drive motors. For example, one embodiment of the present invention comprises an apparatus for actuating four control surfaces with only three drive motors, corresponding to roll, pitch, and yaw. Alternatively, the apparatus may be adapted to control four control surfaces with only two drive motors, corresponding to, for example, pitch and yaw.

Figure 2:
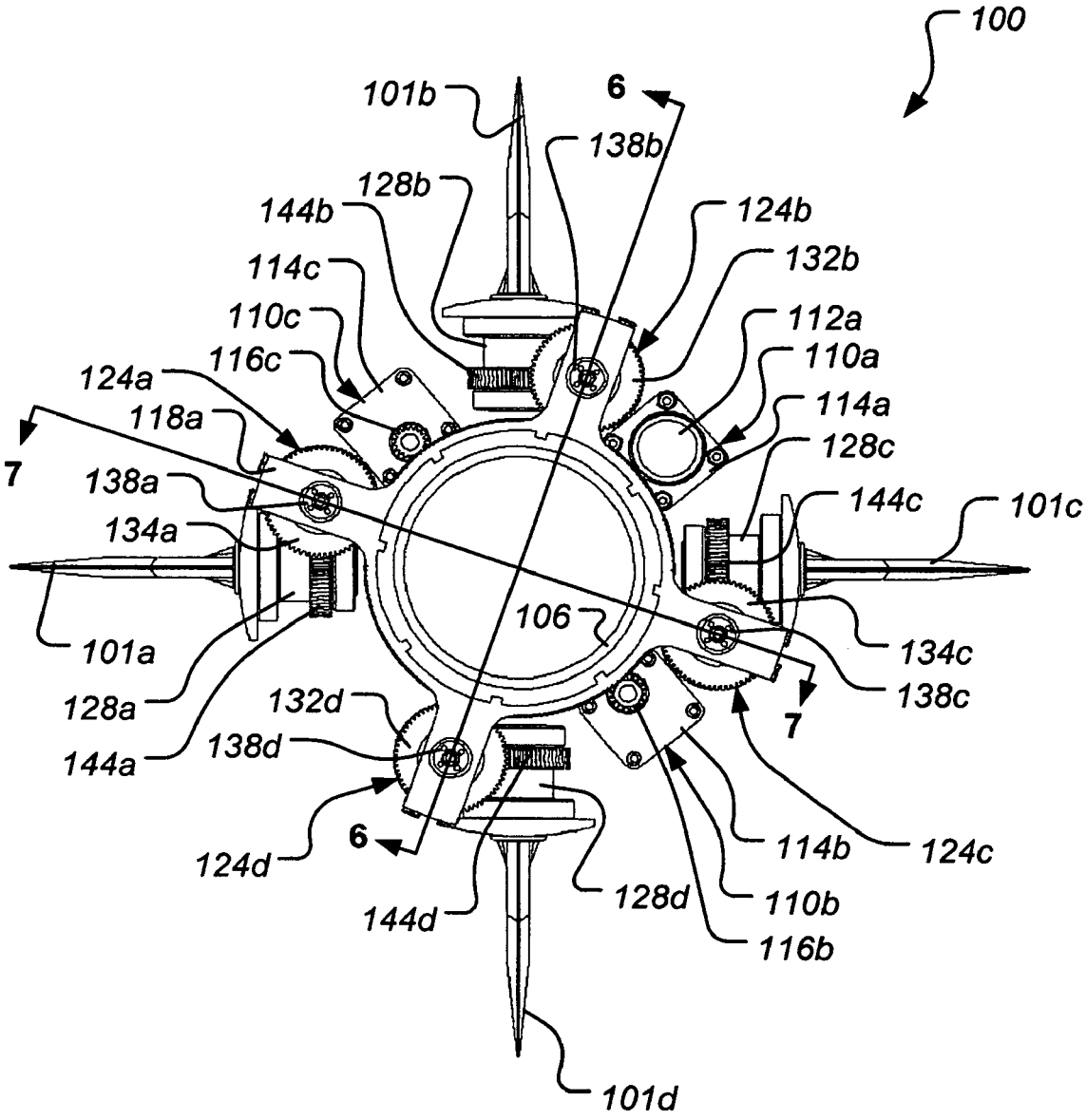
FIG. 2–FIG. 3 are front and rear elevational views, respectively, of the actuation apparatus of FIG. 1 in which a housing has been removed to better illustrate the invention.
Figure 3:
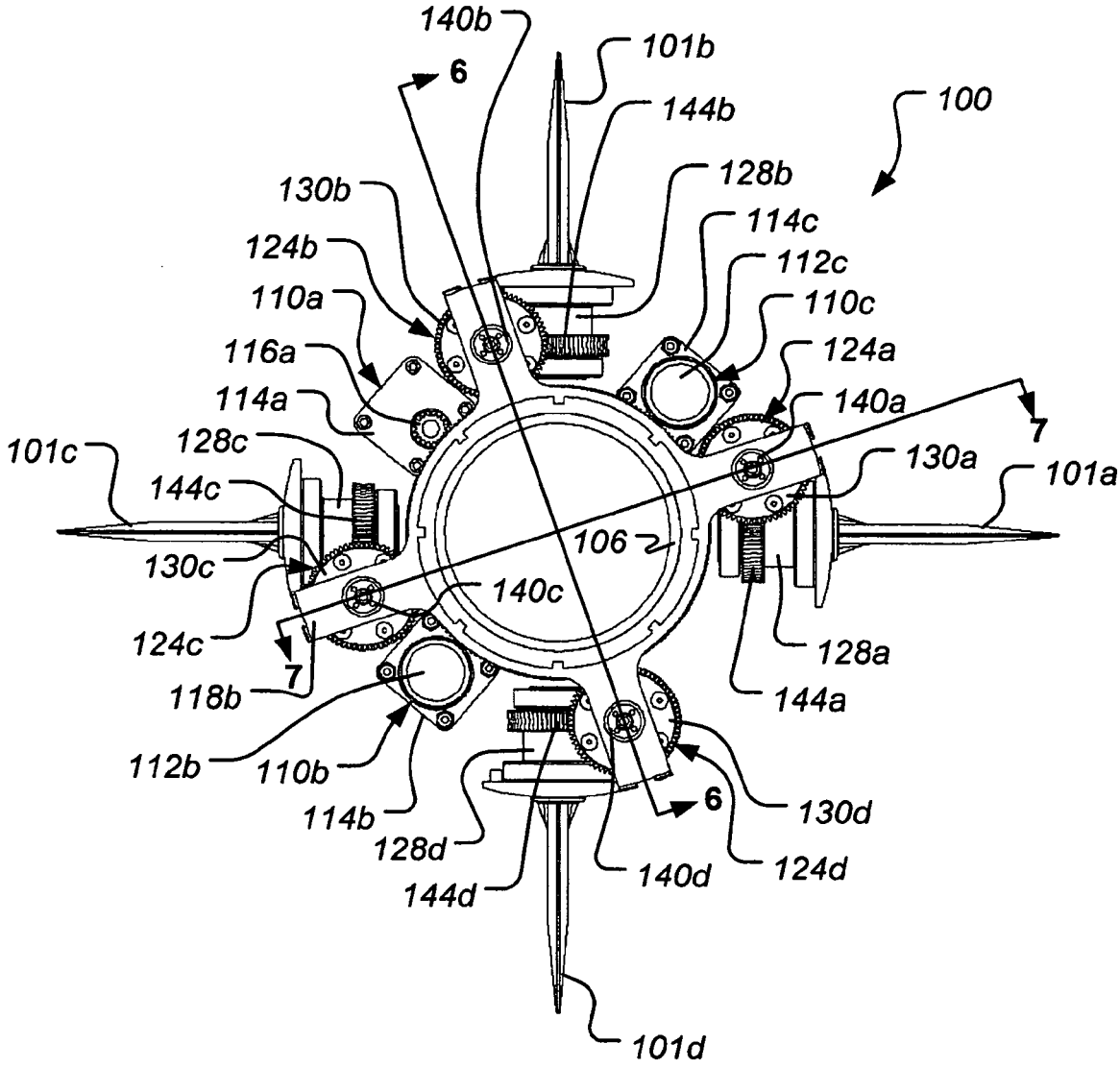
Figure 4:
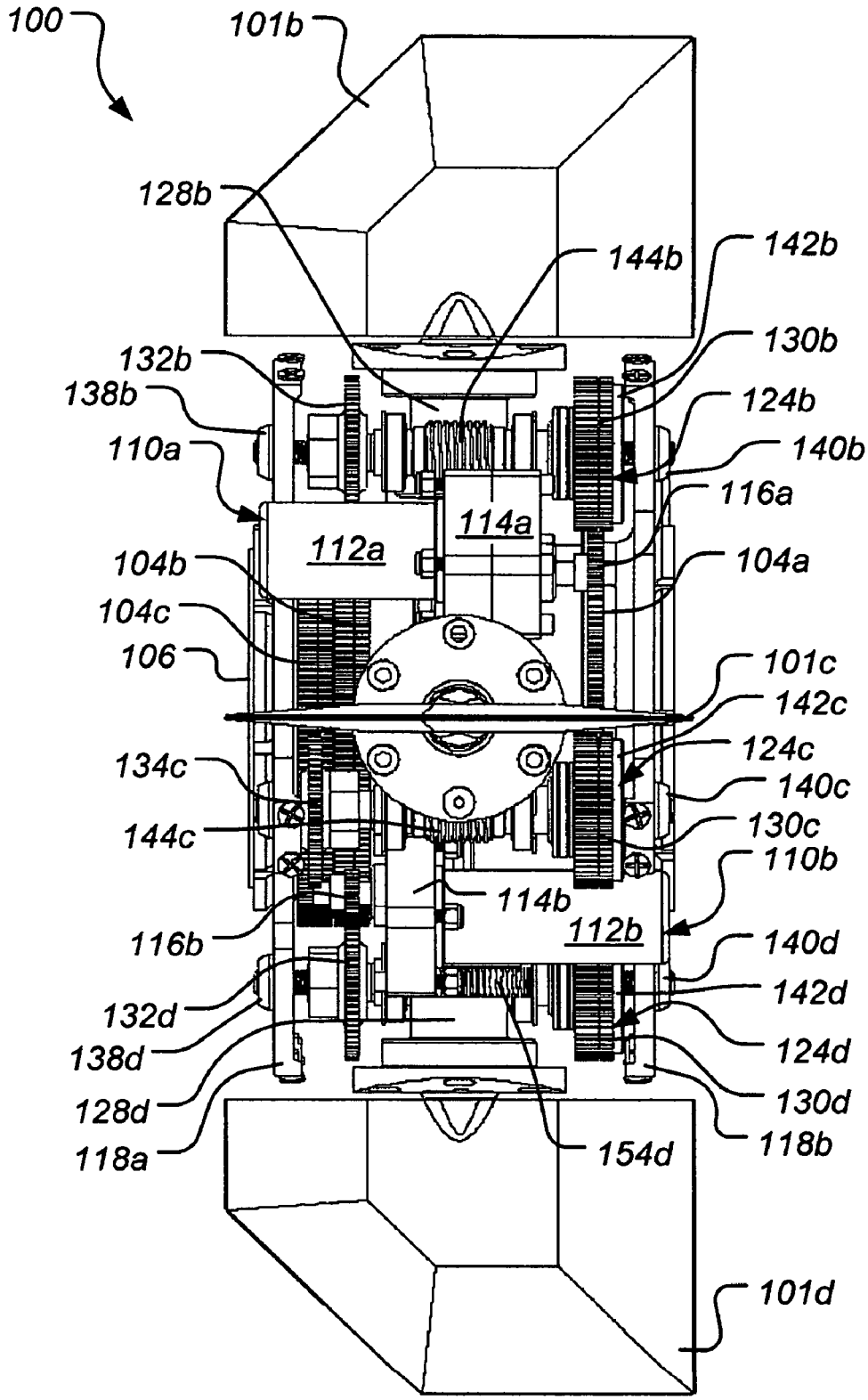
FIG. 4–FIG. 5 are left and right elevational views, respectively, of the actuation apparatus of FIG. 1 in which the housing has been removed to better illustrate the invention.
Figure 5:
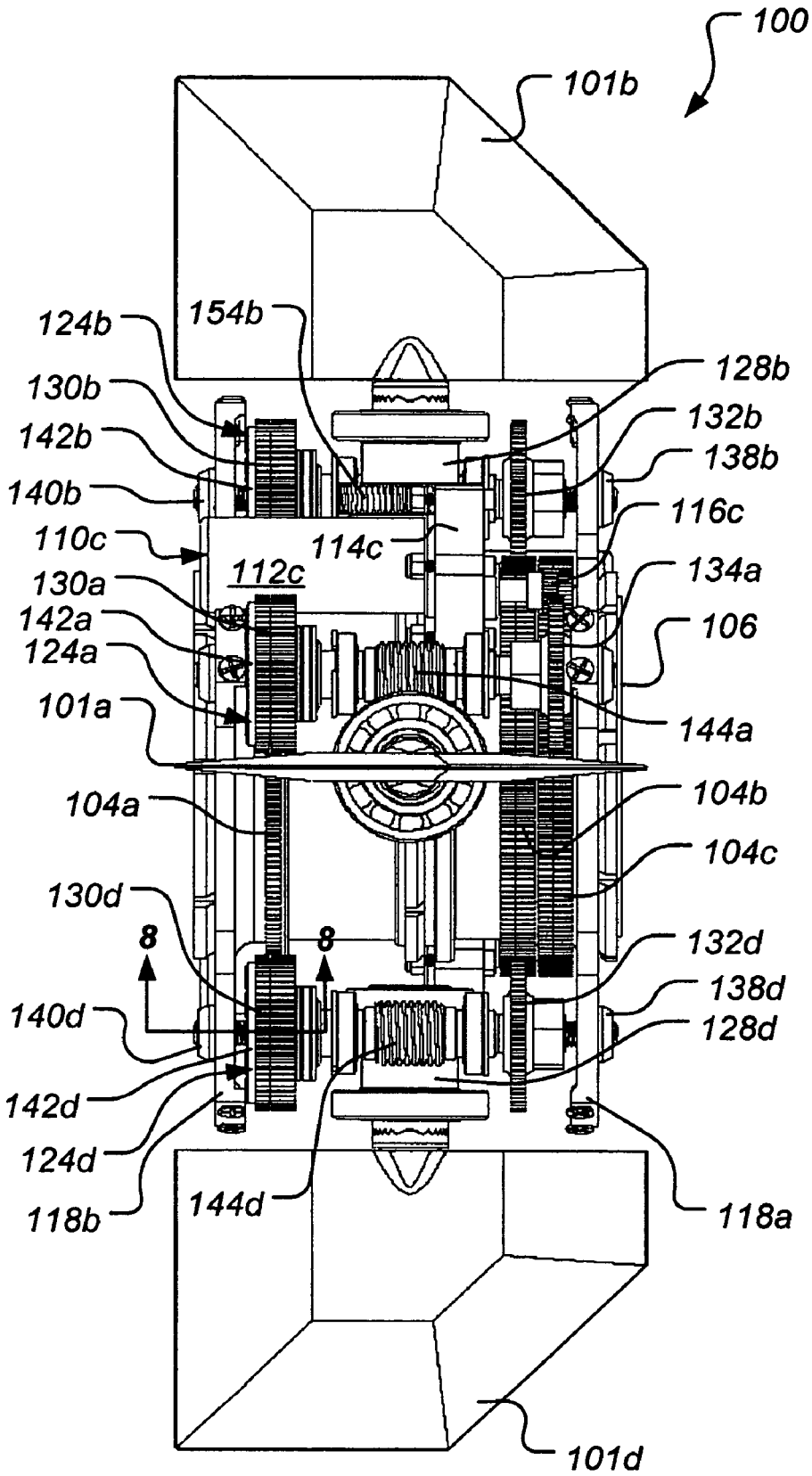
Figure 6:
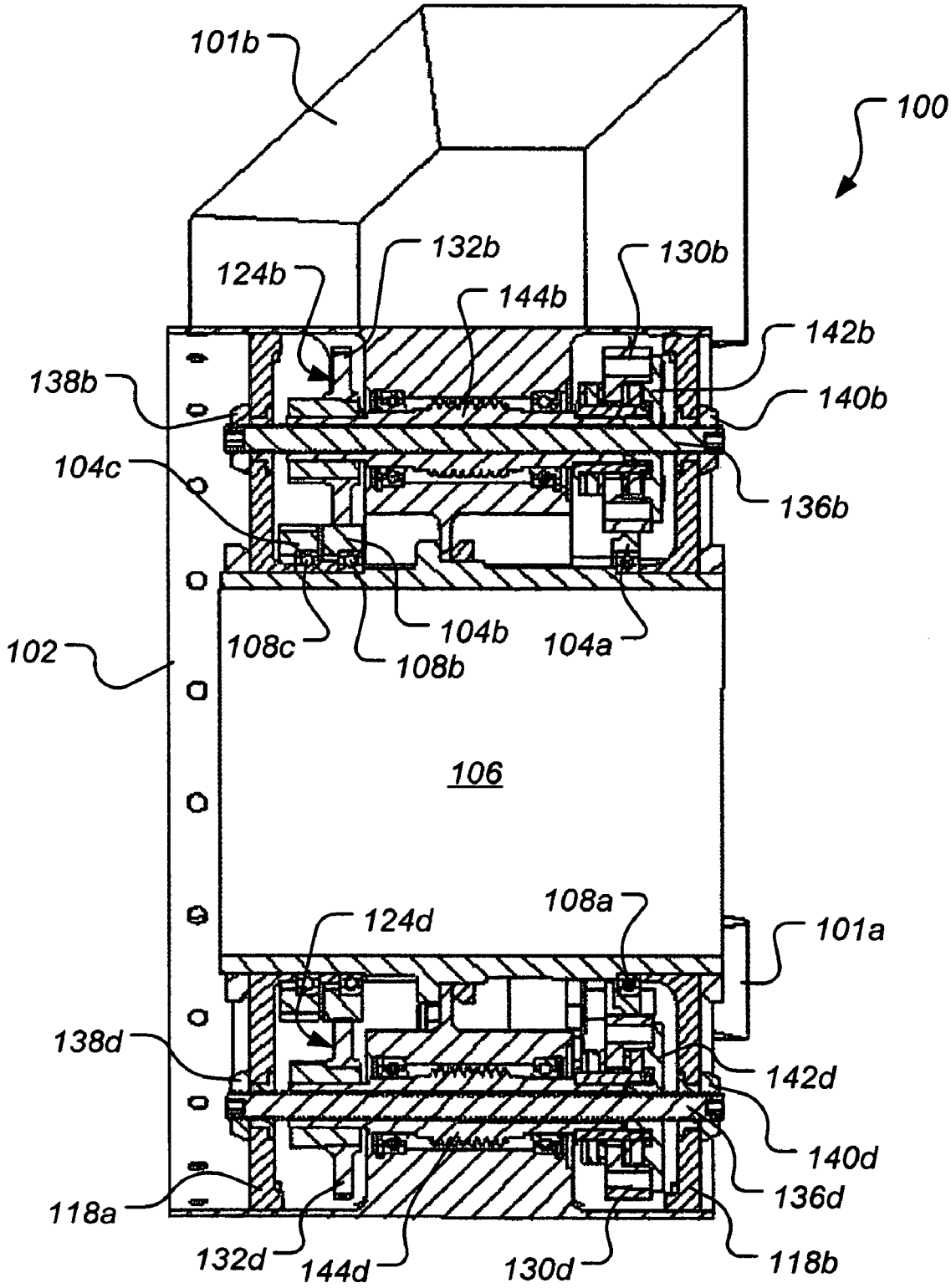
FIG. 6 is a cross sectional view of the actuation apparatus of FIG. 2 and FIG. 3 taken along the line 6—6 of FIG. 2 and FIG. 3.
Figure 7:
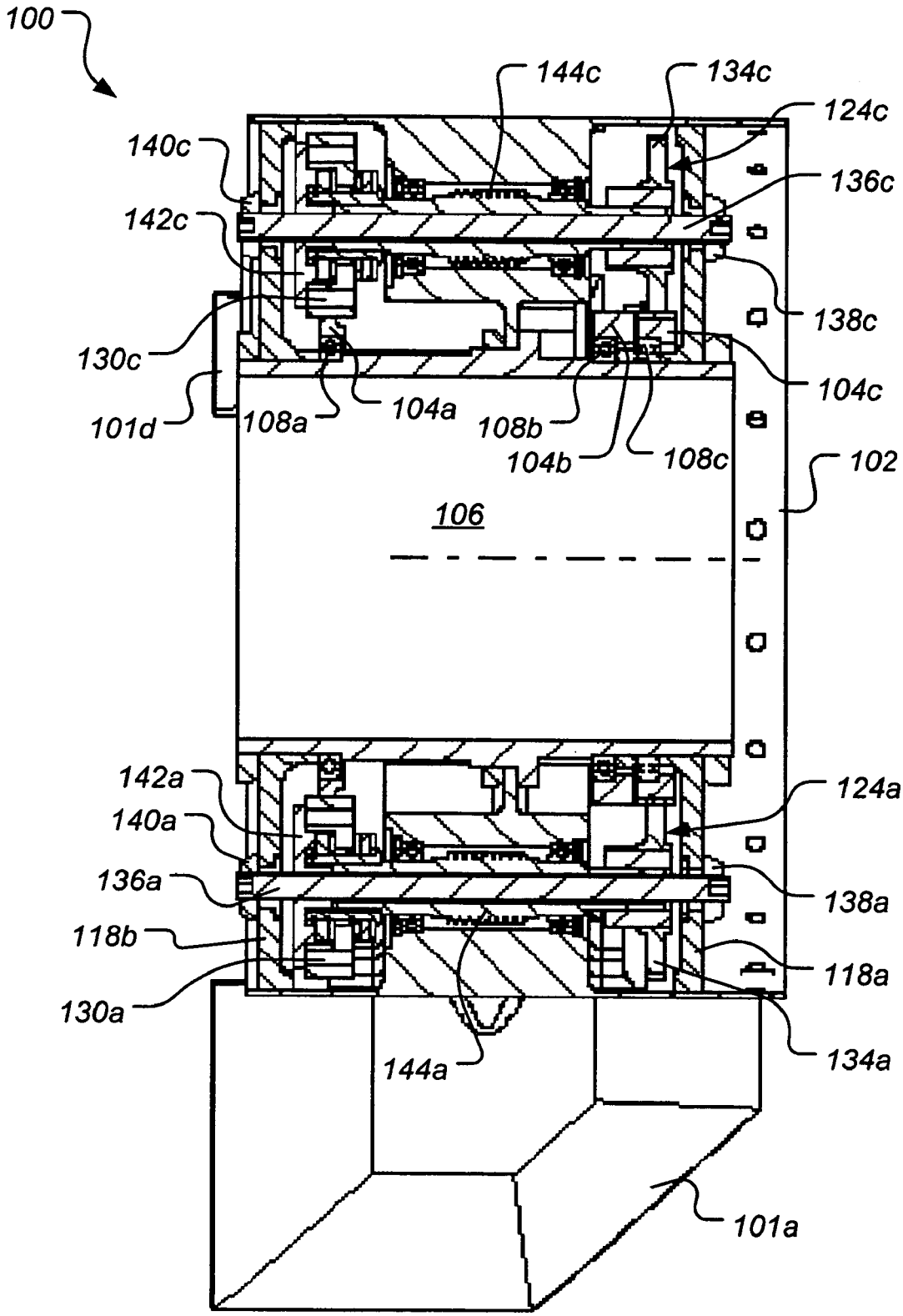
FIG. 7 is a cross sectional view of the actuation apparatus of FIG. 2 and FIG. 3 taken along the line 7—7 of FIG. 2 and FIG. 3.

FIG. 1–FIG. 7 illustrate various views of an embodiment of a control surface actuation apparatus 100 for actuating a plurality of control surfaces 110*a*–110*d* according to the present invention. FIG. 1 is a front, perspective view of the actuation apparatus 100, while FIG. 2–FIG. 3 are front and rear elevational views, respectively, of the actuation apparatus 100 in which a housing 102 (shown only in FIG. 1) has been removed to better illustrate the invention. FIG. 4–FIG. 5 are left and right elevational views, respectively, of the actuation apparatus 100 of FIG. 1, in which the housing 102 has also been removed to better illustrate the invention. FIG. 6–FIG. 7 are cross sectional views of the actuation apparatus 100 taken along line 6—6 and along the line 7—7, respectively, of FIG. 2–FIG. 3.

The actuation apparatus 100 includes a roll spur gear 104*a* (not shown in FIG. 1–FIG. 3), a yaw spur gear 104*b* (not shown in FIG. 2–FIG. 3) and a pitch spur gear 104*c* (also not shown in FIG. 2–FIG. 3). The spur gears 104*a*–104*c* are mounted to a central tube 106 by bearings 108*a*–108*c*, respectively (shown in FIG. 6–FIG. 7), which allow the spur gears 104*a*–104*c* to rotate with respect to the central tube 106.

Mounted to the housing 102 are a roll drive assembly 110*a* (not shown in FIG. 5–FIG. 7), a yaw drive assembly 110*b* (also not shown in FIG. 5–FIG. 7) and a pitch drive assembly 110*c* (not shown in FIG. 4, FIG. 6, or FIG. 7). In the illustrated embodiment, each of the drive assemblies 110*a*–110*c* include a motor 112*a*–112*c*, respectively, coupled with a speed reducer 114*a*–114*c*, respectively. Each of the drive assemblies 110*a*–110*c* also includes a drive gear 116*a*–116*c*, respectively, that is engaged with its corresponding spur gear 104*a*–104*c*. For example, the drive gear 116*a* of the roll drive assembly 110*a* is engaged with the roll spur gear 104*a* and, when driven, the drive gear 116*a* rotates the roll spur gear 104*a* with respect to the central tube 106. The drive assemblies 110*a*–110*c*, however, may take on other configurations.

Each of the drive assemblies 110*a*–110*c* and its corresponding spur gear 104*a*–104*c* comprises an input mechanism. For example, the roll drive assembly 110*a* and the roll spur gear 104*a* comprise a roll input mechanism, in that they provide a roll input to the remainder of the actuation mechanism connected thereto. Correspondingly, the yaw drive assembly 110*b* and the yaw spur gear 104*b* comprise a yaw input mechanism and the pitch drive assembly 110*c* and the pitch spur gear 104*c* comprise a pitch input mechanism.

A forward frame 118*a* (not shown in FIG. 3) and an aft frame 118*b* (not shown in FIG. 1 or FIG. 2) are mounted to the central tube 106 and to the housing 102. Each of the frames 118*a*, 118*b* supports one end of a gear assembly 124*a*–124*d*, as will be more fully described later.

Each of the gear assemblies 124*a*–124*d* is mechanically coupled with one of a plurality of output shafts 128*a*–128*d* (not shown in FIG. 6 or FIG. 7), respectively, which are, in turn, mechanically coupled with the control surfaces 101*a*–101*d* for actuating the control surfaces 101*a*–101*d*. Note that in the description that follows, the elements comprising the gear assemblies 124*a*–124*c*, are identified by a suffix letter (e.g., 128*a*, 132*c*, etc.) indicating to which gear assembly they belong. For example, an element of the gear assemblies 124*a*–124*d* that is identified by the suffix "b" (e.g., 128*b*) is an element of the gear assembly 124*b*.

Referring in particular to FIG. 4–FIG. 5, each of the gear assemblies 124*a*–124*d* comprises a roll gear 130*a*–130*d* engaged with the roll spur gear 104*a*. The roll drive assembly 110*a* actuates the roll spur gear 104*a* and, in turn, the roll spur gear 104*a* actuates the roll gears 130*a*–130*d*. Each of the gear assemblies 124*b*, 124*d* further comprises a yaw gear 132*b*, 132*d* engaged with the yaw spur gear 104*b*, such that the yaw drive assembly 110*b* actuates the yaw spur gear 104*b* that, in turn, actuates the yaw gears 132*b*, 132*d*. Each of the gear assemblies 124*a*, 124*c* further comprises a pitch gear 134*a*, 134*c* engaged with the pitch spur gear 104*c*, such that the pitch drive assembly 110*c* actuates the pitch spur gear 104*c* that, in turn, actuates the pitch gears 134*a*, 134*c*. Thus, in the illustrated embodiment, all of the gear assemblies 124*a*–124*d* are used to control the roll of the vehicle, while only the gear assemblies 124*b*, 124*d* are used to control the yaw of the vehicle and only the gear assemblies 124*a*, 124*c* are used to control the pitch of the vehicle. Alternatively, the gear assemblies 124*b*, 124*d* may used to control the pitch of the vehicle and the gear assemblies 124*a*, 124*c* may be used to control the yaw of the vehicle.

FIG. 6 provides a cross-sectional view of the actuation apparatus 100 taken along the line 6—6 in FIG. 2 and FIG. 3, illustrating one particular construction of the gear assemblies 124*b*, 124*d*, which are used in the illustrated embodiment to control roll and yaw. FIG. 7 depicts a cross-sectional view of the actuation apparatus 100 taken along the line 7—7 in FIG. 2 and FIG. 3, illustrating one particular construction of the gear assemblies 124*a*, 124*c*. These gear assemblies are used in the illustrated embodiment to control roll and pitch. Each of the gear assemblies 124*a*–124*d* includes a shaft 136*a*–136*d* fixedly mounted to the forward frame 118*a* and to the aft frame 118*b* via jam nuts 138*a*–138*d* and 140*a*–140*d*, respectively.

Figure 8:
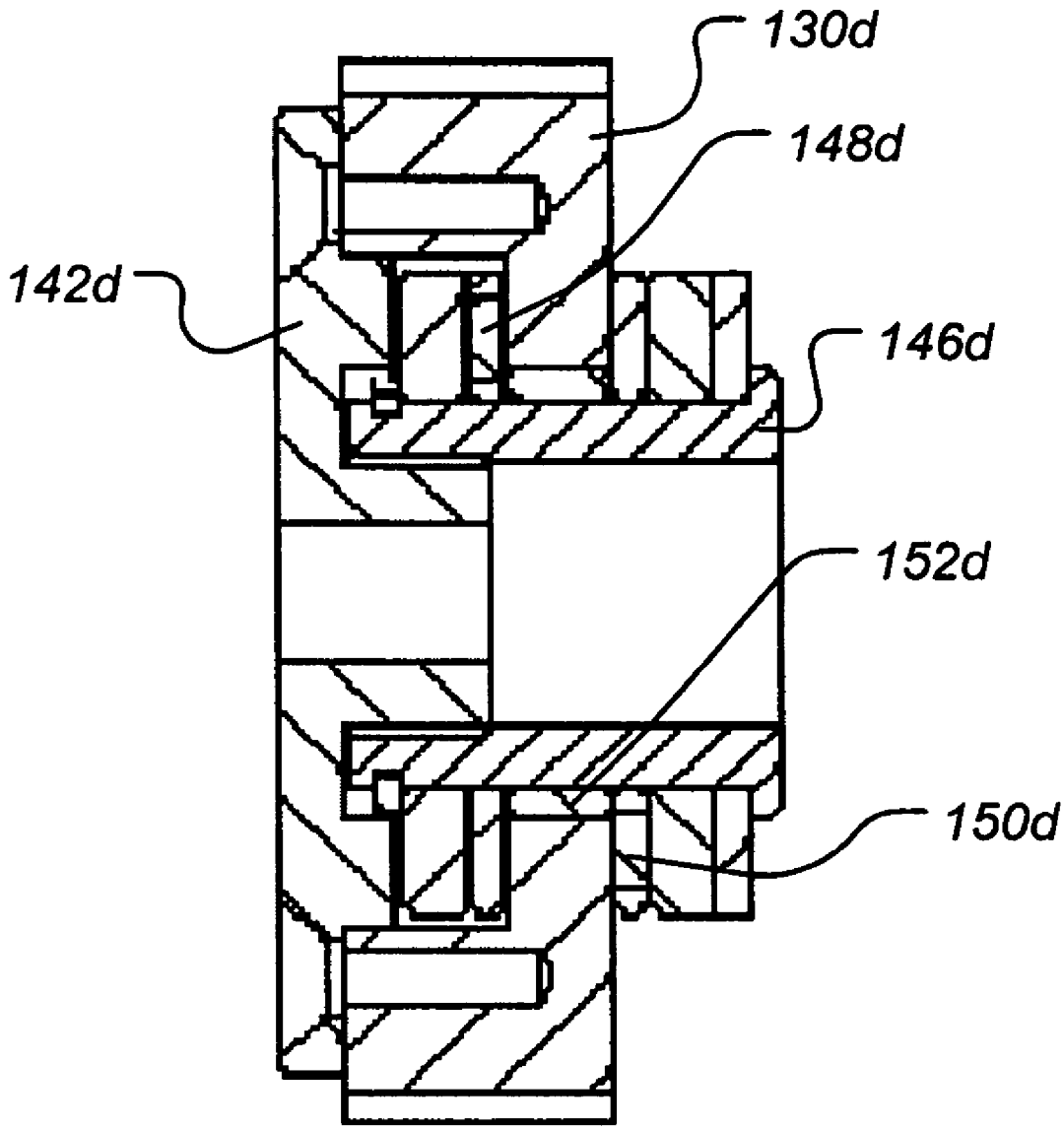
FIG. 8 is a cross-sectional view of a portion of the actuation apparatus of FIG. 2 and FIG. 3 taken along the line 8—8 of FIG. 5.

Referring now to the particular embodiment illustrated in FIG. 8, which is a partial cross-sectional, perspective view taken along the line 8—8 in FIG. 5, the construction of part of the gear assemblies 124*a*–124*d* will be described. Note that, while the discussion relating to FIG. 8 is directed particularly to the gear assembly 124*d*, in one embodiment the gear assemblies 124*a*–124*c* comprise a corresponding construction. In the illustrated embodiment, a thrust nut 142*d* is fixedly attached to the roll gear 130*d*. The thrust nut 142*d* is, in turn, threadedly engaged with the shaft 136*d* (not shown in FIG. 8 but shown in FIG. 7) such that, when the roll gear 130*d* is rotated by the roll spur gear 104*a*, the thrust nut 142*d* traverses along the shaft 136*d*.

Referring now to FIG. 6–FIG. 7, the gear assemblies 124*a*–124*d* also include worms 144*a*–144*d*, which, in the illustrated embodiment, are elongated in nature. Returning to FIG. 8, the worm 144*d* extends into and is fixedly attached to a sleeve 146*d*. In one embodiment, the worm 144*d* is threadedly engaged and bonded with the sleeve 146*d*. The worm 144*d* may be bonded with the sleeve 146*d* with a thread locking compound or the like. The thrust nut 142*d* and the roll gear 130*d* are rotatably coupled with the sleeve 146*d* by thrust bearings 148*d*, 150*d* and by a radial bushing 152*d*. Thus, when the roll gear 130*d* is rotated by the roll spur gear 104*a*, the thrust nut 142*d* traverses along the shaft 136*d*, translating, but not rotating, the worm 144*d*.

Referring again to FIG. 6–FIG. 7, each of the illustrated gear assemblies 124*a*–124*d* further includes a worm gear 154*a*–154*d*, respectively, engaged with its corresponding worm 144*a*–144*d*. The worm gears 154*a*–154*d* are fixedly mounted to their corresponding output shafts 128*a*–128*d*, which, in turn, are attached to the control surfaces 101*a*–101*d*, respectively. As the worms 144*a*–144*d* are translated by their interaction with the thrust nuts 142*a*–142*d*, the worm gears 154*a*–154*d* are rotated, thus rotating the control surfaces 101*a*–101*d*. Note that as the worms 144*a*–144*d* are translated, the yaw gears 132*b*, 132*d* and the pitch gears 134*a*, 134*c* slide along the yaw spur gear 104*b* and the pitch gear 104*c*, respectively, but remain engaged therewith.

Note that the attitudes of the control surfaces 101*a*–101*d* may be initially positioned or tuned by loosening the jam nuts 138*a*–138*d*, 140*a*–140*d* and rotating the shafts 136*a*–136*d*. All, some, or one of the control surfaces 101*a*–101*d* may be initially positioned or tuned in this way.

Note that to effect a change in roll of the vehicle, a pair of opposed control surfaces 101 are rotated in opposite directions with respect to a vehicle datum, which the other pair of opposed control surfaces 101 are rotated in opposite directions with respect to the vehicle datum. Thus, referring to FIG. 6–FIG. 7, the thread direction of the worms 144*a*, 144*b* is opposite that of the worms 144*c*, 144*d*. In other words, for example, if the worms 144*a*, 144*b* comprise right-handed threads, the worms 144*c*, 144*d* comprise left-handed threads.

As presented above, the yaw drive gear 116*b* is meshed with and drives the yaw spur gear 104*b* that, in turn, is meshed with and drives the yaw gears 132*b*, 132*d*. As the yaw gears 132*b*, 132*d* are driven, they rotate the worms 144*b*, 144*d* that, in turn, drive the worm gears 154*b*, 154*d*, causing the output shafts 128*b*, 128*d* and the control surfaces 101*b*, 101*d* to rotate. Similarly, as the pitch gears 134*a*, 134*c* are driven, they rotate the worms 144*a*, 144*c* that, in turn, drive the worm gears 154*a*, 154*c*, causing the output shafts 128*a*, 128*c* and the control surfaces 101*a*, 101*c* to rotate.

In some situations, it may be desirable to only control roll and yaw or roll and pitch. For example, in some embodiments of the present invention, the pitch spur gear 104*c*, the pitch drive assembly 110*c*, and the gear assemblies 124*b*, 124*d* may be omitted, such that only roll and yaw are controlled. In other embodiments, the yaw spur gear 104*b*, the yaw drive assembly 110*b*, and the gear assemblies 124*a*, 124*c* may be omitted, such that only roll and pitch are controlled. Thus, the scope of the present invention encompasses embodiments wherein only some of roll, yaw, and pitch are controlled. Moreover, the actuation apparatus 100 mechanically combines two inputs (e.g., the desired changes in roll and yaw, or the desired changes in roll and pitch) into a single mechanical output to each of the control surfaces 101*a*–101*d*. While the accompanying figures illustrate the gear assemblies 124*a*–124*d* having a generally common design, the present invention is not so limited. Rather, one or more of the gear assemblies 124*a*–124*d* may have configurations other than those illustrated.

Figure 9:
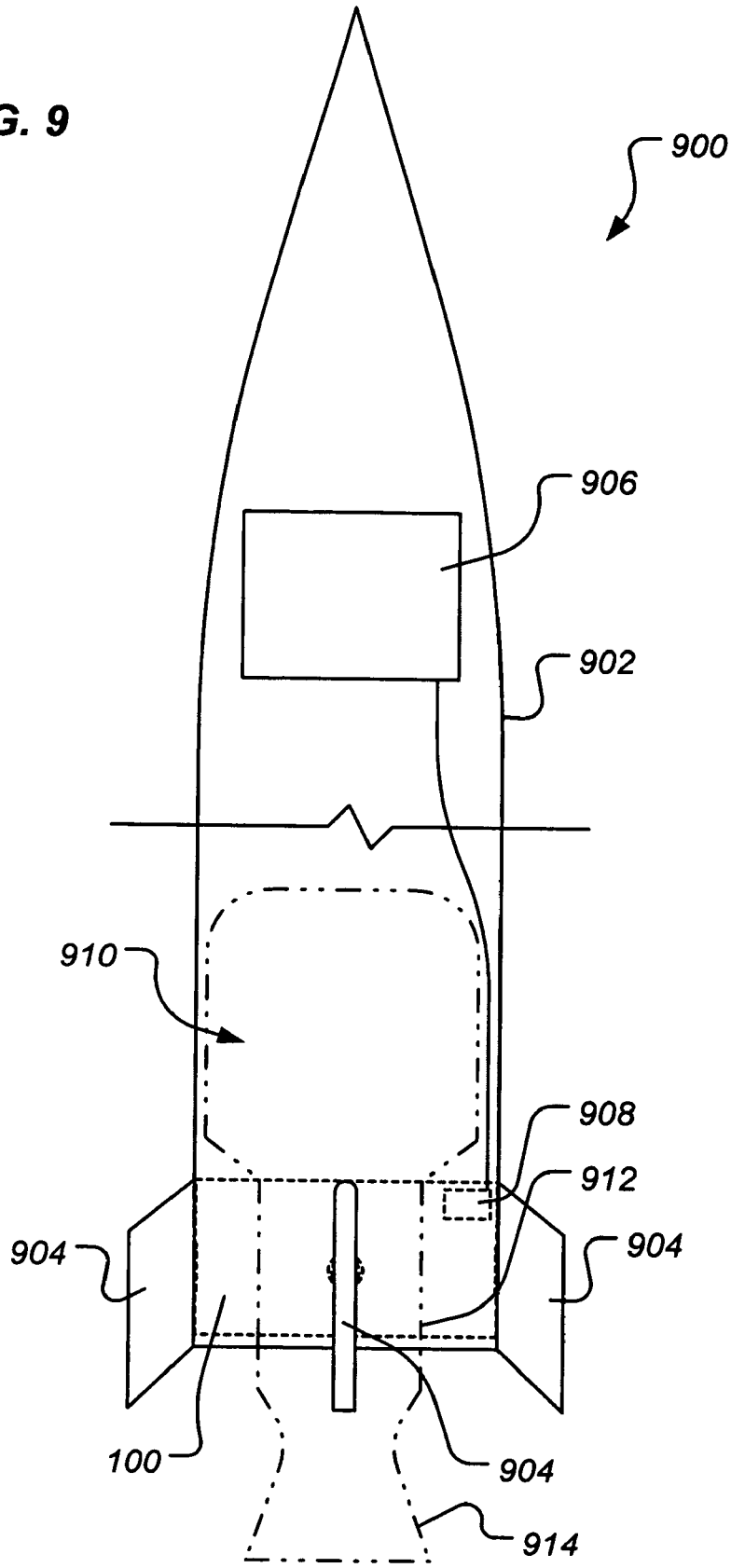
FIG. 9 is a stylized side view of a projectile incorporating an actuation apparatus according to the present invention.

FIG. 9 depicts an illustrative application for the actuation apparatus 100, in which the actuation apparatus 100 forms part of a vehicle 900. In this embodiment, the actuation apparatus is disposed within a body 902 of the vehicle 900 and the control surfaces 101*a*–101*d* are attached to the output shafts 128*a*–128*d*, respectively, of the actuation apparatus 100. In operation, the desired attitude (i.e., the roll, yaw, and pitch) of the vehicle 900 with respect to a datum is provided by, for example, a guidance or trajectory controller 906 within the body 902 of the vehicle 900 to an actuation controller 908. The actuation controller 908, in turn, provides commands to the drive assemblies 110*a*–110*c* to effect articulation of the control surfaces 904.

In the illustrated embodiment, the vehicle 900 comprises a rocket motor 910 (shown in phantom) that includes a blast tube 912. Generally, blast tubes (e.g., the blast tube 912) carry combustion products resulting from ignited propellant to the motor's nozzle (e.g., a nozzle 914). While not required, some embodiments of the present invention may utilize the blast tube 912 as the central tube 106 (shown in FIG. 1–FIG. 6). Note that other elements or structures, such as a drive shaft or the like (not shown) coupled with a propeller (also, not shown), may extend through the actuation apparatus 100 instead of the blast tube 912.

While the vehicle 900 is depicted in FIG. 9 as having a particular configuration, the present invention is not so limited. Rather, the vehicle 900 may comprise any airborne or water borne vehicle, for example, a rocket, a missile, a projectile, a torpedo, or any other vehicle comprising control surfaces (e.g., the control surfaces 101*a*–101*d*).

It is to be noticed that the term "comprising", used in the claims, should not be interpreted as being limitative to the elements listed thereafter. Thus, the scope of the expression "a device comprising elements A and B" should not be limited to devices consisting only of components A and B. It means that with respect to the present invention, the only relevant components of the device are A and B.

Similarly, it is to be noticed that the term "coupled", also used in the claims, should not be interpreted as being limitative to direct connections only. Thus, the scope of the expression "a device A coupled to a device B" should not be limited to devices or systems wherein device A is directly connected to device B or an output of device A is directly connected to an input of device B. It means that there exists a connection path between A and B, which may be a path including other devices or means.

Further, even though the components of the present invention are described herein as being "roll", "pitch", or "yaw" components, the present invention is not so limited. Rather, the present invention encompasses the embodiments disclosed herein and their equivalents irrespective of whether the invention is used to control roll, pitch and/or yaw. In some embodiments, the labels "roll", "pitch", and "yaw" are merely identifiers for distinguishing elements of the apparatus of the present invention. For example, the scope of the present invention encompasses the use of the disclosed apparatus to combine two inputs (e.g., pitch and roll, or yaw and roll) into a single output (e.g., a pitch and roll output or a yaw and roll output).

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus for actuating a control surface, comprising:

a first spur gear;

a first drive assembly engaged with the first spur gear;

a second spur gear;

a second drive assembly engaged with the second spur gear; and a gear assembly engaged with the first spur gear and the second spur gear and adapted to be coupled with the control surface;

wherein the gear assembly comprises:

a first gear engaged with the first spur gear;

a second gear engaged with the second spur gear;

a worm fixedly coupled with the first gear;

a thrust nut fixedly coupled with the second gear and coupled with the worm. such that the worm translates when the thrust nut is rotated by the second gear;

a worm gear engaged with the worm; and an output shaft fixedly attached to the worm gear and adapted to be coupled with the control surface.

2. An apparatus, according to claim 1, further comprising a shaft, such that the thrust nut is threadedly engaged with the shaft and translates along the shaft when rotated by the second gear.

3. An apparatus, according to claim 1, wherein at least one of the first drive assembly and the second drive assembly comprises a motor, a speed reducer coupled with the motor, and a drive gear coupled with the speed reducer and engaged with the first spur gear.

4. An apparatus, according to claim 1, wherein the first drive assembly comprises one of a yaw drive assembly and a pitch drive assembly and the second drive assembly comprises a roll drive assembly.

5. An apparatus for actuating a plurality of control surfaces, comprising:

a first spur gear, a second spur gear, and a third spur gear;

a first drive assembly engaged with the first spur gear;

a second drive assembly engaged with the second spur gear;

a third drive assembly engaged with the third spur gear;

a first gear assembly engaged with the first spur gear and third spur gear and adapted to be coupled to a first of the plurality of control surfaces; and a second gear assembly engaged with the second spur gear and the third spur gear and adapted to be coupled to a second of the plurality of control surf aces;

wherein the first gear assembly comprises:

a first gear engaged with the first spur gear;

a second gear engaged with the third sour gear;

a worm fixedly coupled with the first gear;

a thrust nut fixedly coupled with the second gear and coupled with the worm, such that the worm translates when the thrust nut is rotated by the second gear;

a worm gear engaged with the worm; and an output shaft fixedly attached to the worm gear and adapted to be coupled with the first control surface.

6. An apparatus, according to claim 5, further comprising a shaft, such that the thrust nut is threadedly engaged with the shaft and translates along the shaft when rotated by the second gear.

7. An apparatus, according to claim 5, wherein the second gear assembly comprises:

a first gear engaged with the second spur gear;

a second gear engaged with the third spur gear;

a worm fixedly coupled with the first gear;

a thrust nut fixedly coupled with the second gear and coupled with the worm, such that the worm translates when the thrust nut is rotated by the second gear;

a worm gear engaged with the worm; and an output shaft fixedly attached to the worm gear and adapted to be coupled with the second control surface.

8. An apparatus, according to claim 7, further comprising a shaft, such that the thrust nut is threadedly engaged with the shaft and translates along the shaft when rotated by the second gear.

9. An apparatus, according to claim 5, wherein the first drive assembly comprises one of a yaw drive assembly and a pitch drive assembly and the second drive assembly comprises a roll drive assembly.

10. An apparatus, according to claim 5, wherein at least one of the first drive assembly, the second drive assembly, and the third drive assembly comprises a motor, a speed reducer coupled with the motor, and a drive gear coupled with the speed reducer and engaged with its corresponding spur gear.

11. An apparatus, according to claim 5, wherein the first drive assembly comprises a yaw drive assembly, the second drive assembly comprises a pitch drive assembly and the third drive assembly comprises a roll drive assembly.

12. A vehicle, comprising:

a plurality of control surfaces;

a first spur gear, a second spur gear, and a third spur gear;

a first drive assembly engaged with the first spur gear;

a second drive assembly engaged with the second spur gear;

a third drive assembly engaged with the third spur gear;

a first gear assembly engaged with the first spur gear and third spur gear and coupled with a first of the plurality of control surfaces; and a second gear assembly engaged with the second spur gear and the third spur gear and coupled with a second of the plurality of control surfaces;

wherein the first gear assembly comprises:

a first gear engaged with the first spur gear;

a second gear engaged with the third spur gear;

a worm fixedly coupled with the first gear;

a thrust nut fixedly coupled with the second gear and coupled with the worm, such that the worm translates when the thrust nut is rotated by the second gear;

a worm gear engaged with the worm; and an output shaft fixedly attached to the worm gear and coupled with the first control surface.

13. A vehicle, according to claim 12, further comprising a shaft, such that the thrust nut is threadedly engaged with the shaft and translates along the shaft when rotated by the second gear.

14. A vehicle, according to claim 12, wherein the second gear assembly comprises:

a first gear engaged with the second spur gear;

a second gear engaged with the third spur gear;

a worm fixedly coupled with the first gear;

a thrust nut fixedly coupled with the second gear and coupled with the worm, such that the worm translates when the thrust nut is rotated by the second gear;

a worm gear engaged with the worm; and an output shaft fixedly attached to the worm gear and coupled with the second control surface.

15. A vehicle, according to claim 14, further comprising a shaft, such that the thrust nut is threadedly engaged with the shaft and translates along the shaft when rotated by the second gear.

16. A vehicle, according to claim 12, wherein the first drive assembly comprises one of a yaw drive assembly and a pitch drive assembly and the second drive assembly comprises a roll drive assembly.

17. A vehicle, according to claim 12, wherein at least one of the first drive assembly, the second drive assembly, and the third drive assembly comprises a motor, a speed reducer coupled with the motor, and a drive gear coupled with the speed reducer and engaged with its corresponding spur gear.

18. A vehicle, according to claim 12, wherein the first drive assembly comprises a yaw drive assembly, the second drive assembly comprises a pitch drive assembly and the third drive assembly comprises a roll drive assembly.

19. A vehicle, comprising:

a first yaw and roll control surface, a second yaw and roll control surface, a first pitch and roll control surface, and a second pitch and roll control surface;

a yaw spur gear, a pitch spur gear, and a roll spur gear;

a yaw drive assembly engaged with the yaw spur gear;

a pitch drive assembly engaged with the pitch spur gear;

a roll drive assembly engaged with the roll spur gear;

a first yaw and roll gear assembly engaged with the yaw spur gear and roll spur gear and coupled with the first yaw and roll control surface;

a second yaw and roll gear assembly engaged with the yaw spur gear and roll spur gear and coupled with the second yaw and roll control surface;

a first pitch and roll gear assembly engaged with the pitch spur gear and the roll spur gear and coupled with the first pitch and roll control surface; and a second pitch and roll gear assembly engaged with the pitch spur gear and the roll spur gear and coupled with the second pitch and roll control surface;

wherein at least one of the yaw and roll gear assemblies comprises:

a first gear engaged with the yaw sour gear;

a second gear engaged with the roll sour gear;

a worm fixedly coupled with the first gear;

a thrust nut fixedly coupled with the second gear and coupled with the worm, such that the worm translates when the thrust nut is rotated by the second gear;

a worm gear engaged with the worm; and an output shaft fixedly attached to the worm gear and coupled with its corresponding control surface.

20. A vehicle, according to claim 19, further comprising a shaft, such that the thrust nut is threadedly engaged with the shaft and translates along the shaft when rotated by the second gear.

21. A vehicle, comprising:

a first yaw and roll control surface, a second yaw and roll control surface, a first pitch and roll control surface, and a second pitch and roll control surface;

a yaw spur gear, a pitch spur gear, and a roll spur gear;

a yaw drive assembly engaged with the yaw spur gear;

a pitch drive assembly engaged with the pitch spur gear;

a roll drive assembly engaged with the roll spur gear;

a first yaw and roll gear assembly engaged with the yaw spur gear and roll spur gear and coupled with the first yaw and roll control surface;

a second yaw and roll gear assembly engaged with the yaw spur gear and roll spur gear and coupled with the second yaw and roll control surface;

a first pitch and roll gear assembly engaged with the pitch spur gear and the roll spur gear and coupled with the first pitch and roll control surface; and a second pitch and roll gear assembly engaged with the pitch spur gear and the roll spur gear and coupled with the second pitch and roll control surface;

wherein at least one of the pitch and roll gear assemblies comprises:

a first gear engaged with the pitch spur gear;

a second gear engaged with the roll spur gear;

a worm fixedly coupled with the first gear;

a thrust nut fixedly coupled with the second gear and coupled with the worm, such that the worm translates when the thrust nut is rotated by the second gear;

a worm gear engaged with the worm; and an output shaft fixedly attached to the worm gear and coupled with its corresponding control surface.

22. A vehicle, according to claim 21, further comprising a shaft, such that the thrust nut is threadedly engaged with the shaft and translates along the shaft when rotated by the second gear.

23. A vehicle, according to claim 19, wherein at least one of the yaw drive assembly, the pitch drive assembly, and the roll drive assembly comprises a motor, a speed reducer coupled with the motor, and a drive gear coupled with the speed reducer and engaged with its corresponding spur gear.

24. A vehicle, according to claim 21, wherein at least one of the yaw drive assembly, the pitch drive assembly, and the roll drive assembly comprises a motor, a speed reducer coupled with the motor, and a drive gear coupled with the speed reducer and engaged with its corresponding spur gear.

* * * * *

UNITED STATES PATENT AND TRADEMARK OFFICE

CERTIFICATE OF CORRECTION

PATENT NO. : 7,246,539 B1
APPLICATION NO. : 11/034044
DATED : July 24, 2007
INVENTOR(S) : Mark A Turner It is certified that error appears in the above-identified patent and that said Letters Patent is hereby corrected as shown below:

In column 7, line 54, cancel the text beginning with "5. An apparatus" to and ending with "control surface." in column 8, line 10, and insert the following claim:

--5. An apparatus for actuating a plurality of control surfaces, comprising:
a first spur gear, a second spur gear, and a third spur gear;
a first drive assembly engaged with the first spur gear;
a second drive assembly engaged with the second spur gear;
a third drive assembly engaged with the third spur gear;
a first gear assembly engaged with the first spur gear and third spur gear and adapted to be coupled to a first of the plurality of control surfaces; and
a second gear assembly engaged with the second spur gear and the third spur gear and adapted to be coupled to a second of the plurality of control surfaces;
wherein the first gear assembly comprises:
a first gear engaged with the first spur gear;
a second gear engaged with the third spur gear;
a worm fixedly coupled with the first gear;
a thrust nut fixedly coupled with the second gear and coupled with the worm, such that the worm translates when the thrust nut is rotated by the second gear;
a worm gear engaged with the worm; and
an output shaft fixedly attached to the worm gear and adapted to be coupled with the first control surface.--

In column 9, line 33, cancel the text beginning with "19. A vehicle" to and ending with "control surface." in column 10, line 6, and insert the following claim:

--19. A vehicle, comprising:
a first yaw and roll control surface, a second yaw and roll control surface, a first pitch and roll control surface, and a second pitch and roll control surface;
a yaw spur gear, a pitch spur gear, and a roll spur gear;
a yaw drive assembly engaged with the yaw spur gear;
a pitch drive assembly engaged with the pitch spur gear;
a roll drive assembly engaged with the roll spur gear;
a first yaw and roll gear assembly engaged with the yaw spur gear and roll spur gear and coupled with the first yaw and roll control surface;
a second yaw and roll gear assembly engaged with the yaw spur gear and roll spur gear and coupled with the second yaw and roll control surface;
a first pitch and roll gear assembly engaged with the pitch spur gear and the roll spur gear and coupled with the first pitch and roll control surface; and
a second pitch and roll gear assembly engaged with the pitch spur gear and the roll spur gear and coupled with the second pitch and roll control surface;

UNITED STATES PATENT AND TRADEMARK OFFICE

CERTIFICATE OF CORRECTION

PATENT NO. : 7,246,539 B1
APPLICATION NO. : 11/034044
DATED : July 24, 2007
INVENTOR(S) : Mark A Turner It is certified that error appears in the above-identified patent and that said Letters Patent is hereby corrected as shown below:

wherein at least one of the yaw and roll gear assemblies comprises:
a first gear engaged with the yaw spur gear;
a second gear engaged with the roll spur gear;
a worm fixedly coupled with the first gear;
a thrust nut fixedly coupled with the second gear and coupled with the worm, such that the worm translates when the thrust nut is rotated by the second gear;
a worm gear engaged with the worm; and
an output shaft fixedly attached to the worm gear and coupled with its corresponding control surface.--

Signed and Sealed this

Fourteenth Day of October, 2008

JON W. DUDAS
*Director of the United States Patent and Trademark Office*